US007585395B2

(12) United States Patent
Quigley et al.

(10) Patent No.: US 7,585,395 B2
(45) Date of Patent: Sep. 8, 2009

(54) STRUCTURED FORMING FABRIC

(75) Inventors: Scott D. Quigley, Bossier City, LA (US); Thomas Thoröe Scherb, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 169 days.

(21) Appl. No.: 11/753,435

(22) Filed: May 24, 2007

(65) Prior Publication Data

US 2007/0272385 A1 Nov. 29, 2007

Related U.S. Application Data

(63) Continuation-in-part of application No. 10/768,550, filed on Jan. 30, 2004, now Pat. No. 7,387,706.

(51) Int. Cl.
*D21F 1/18* (2006.01)

(52) U.S. Cl. ..... 162/358.4; 162/358.1; 162/203; 162/309; 442/193; 442/195

(58) Field of Classification Search ..... 162/358.4, 162/358.1, 309, 308, 109, 203, 904, 267; 442/193, 195, 203
See application file for complete search history.

(56) References Cited

U.S. PATENT DOCUMENTS

| | | | | |
|---|---|---|---|---|
| 4,191,609 | A | 3/1980 | Trokhan | 162/113 |
| 5,429,686 | A | 7/1995 | Chiu et al. | 139/383 |
| 6,237,644 | B1 | 5/2001 | Hay et al. | 139/383 |
| 6,592,714 | B2 | 7/2003 | Lamb | 162/116 |
| 6,649,026 | B2 | 11/2003 | Lamb | 162/348 |
| 2004/0094223 | A1 * | 5/2004 | Johnson et al. | 139/383 A |
| 2004/0237210 | A1 * | 12/2004 | Thoroe-Scherb et al. | 8/115.51 |

FOREIGN PATENT DOCUMENTS

| | | |
|---|---|---|
| WO | WO03/062528 | 7/2003 |
| WO | WO2005/035867 | 4/2005 |
| WO | WO2006/113818 | 10/2006 |

* cited by examiner

*Primary Examiner*—Mark Halpern
(74) *Attorney, Agent, or Firm*—Taylor & Aust, P.C.

(57) ABSTRACT

A fabric for use by a papermaking machine, the fabric including a plurality of weft yarns, a plurality of warp yarns, and a woven fabric resulting from a repeating pattern of the weft yarns and warp yarns. Each of the weft yarn in the repeating pattern having a sequence of starting at a starting point then sequentially going over three adjacent warp yarns, under one warp yarn, over one warp yarn, under three warp yarns, over one warp yarn and under one warp yarn, the sequence then repeating.

10 Claims, 16 Drawing Sheets

| | | | | | |
|---|---|---|---|---|---|
| x | x | | x | x | 5 |
| x | x | x | x | | 4 |
| x | | x | x | x | 3 |
| x | x | x | | x | 2 |
| | x | x | x | x | 1 |
| 1 | 2 | 3 | 4 | 5 | |

| | | | | | |
|---|---|---|---|---|---|
| | x | | x | x | 5 |
| | x | x | | x | 4 |
| x | | x | | x | 3 |
| x | | x | x | | 2 |
| x | x | | x | | 1 |
| 1 | 2 | 3 | 4 | 5 | |

28

| | | | | | | | | | | |
|---|---|---|---|---|---|---|---|---|---|---|
| X | X | | X | | | | X | | X | 10 |
| X | | | | X | | X | X | X | | 9 |
| | X | | X | X | X | | X | | | 8 |
| X | X | X | | X | | | | X | | 7 |
| | X | | | | X | | X | X | X | 6 |
| | | X | | X | X | X | | X | | 5 |
| | X | X | X | | X | | | | X | 4 |
| X | | X | | | | X | | X | X | 3 |
| | | | X | | X | X | X | | X | 2 |
| X | | X | X | X | | X | | | | 1 |
| 1 | 2 | 3 | 4 | 5 | 6 | 7 | 8 | 9 | 10 | |

STRUCTURED FORMING FABRIC

CROSS REFERENCE TO RELATED APPLICATIONS

This is a continuation-in-part of U.S. patent application Ser. No. 10/768,550, entitled "APPARATUS FOR AND PROCESS OF MATERIAL WEB FORMATION ON A STRUCTURED FABRIC IN A PAPER MACHINE", filed Jan. 30, 2004 now U.S. Pat. No. 7,387,706.

BACKGROUND OF THE INVENTION

1. Field of the Invention

The present invention relates to a method of forming a structured fiber web on a paper machine, and, more particularly, to a method and apparatus of forming a structured fiber web on a structured forming fabric in a paper machine.

2. Description of the Related Art

In a wet molding process, a structured fabric in a Crescent Former configuration impresses a three dimensional surface on a web while the fibrous web is still wet. Such an invention is disclosed in International Publication No. WO 03/062528 A1. A suction box is disclosed for the purpose of shaping the fibrous web while wet to generate the three dimensional structure by removing air through the structural fabric. It is a physical displacement of portions of the fibrous web that leads to the three dimensional surface. Similar to the aforementioned method, a through air drying (TAD) technique is disclosed in U.S. Pat. No. 4,191,609. The TAD technique discloses how an already formed web is transferred and molded into an impression fabric. The transformation takes place on a web having a sheet solids level greater than 15%. This results in a low density pillow area in the fibrous web. These pillow areas are of a low basis weight since the already formed web is expanded to fill the valleys thereof. The impression of the fibrous web into a pattern, on an impression fabric, is carried out by passing a vacuum through the impression fabric to mold the fibrous web.

It is known to form a fiber web in a wet molding process using a structured fabric to impress a three dimensional surface on the web while the fibrous web is still wet. Such an invention is disclosed in International Publication No. WO 03/062528 A1. It is known to use forming fabrics, which have a load bearing layer and a sculptured layer wherein impression knuckles are formed, which imprint the sheet to increase the surface contour. Such an invention is disclosed in U.S. Pat. No. 5,429,686. However, this patent does not teach the creation of pillows on a sheet that are required for effective dewatering in through air drying (TAD) applications and in particular of an ATMOS™ papermaking machine. U.S. Pat. No. 6,237,644 teaches the use of fabrics, which are woven with a lattice pattern of at least three yarns oriented in both warp and weft. This reference teaches the use of a pattern fabric to provide shallow craters in distinct patterns. The physical displacement of portions of the fibrous web is a technique utilized to lead to a three-dimensional surface. A TAD technique is disclosed in U.S. Pat. No. 4,191,609. The TAD technique discloses how an already formed web is transferred and molded into an impression fabric. The transformation takes place on a web having a sheet solids level greater than 15%. This results in a low density pillow area in the fibrous web having a low basis weight, since the already formed web is expanded to fill the valleys. The impressions of the fibrous web into a pattern is carried out by passing a vacuum through the impression fabric to mold the fibrous web.

Prior art weave patterns such as the M weave illustrated in FIGS. 19-21 and the G weave shown in FIGS. 22-24 illustrate prior art fabrics that limit the amount of bulk that can be built into the fibrous web due to the shallow depth of the pockets. The weave patterns of the M weave and G weave are each based on a 5 by 5 pattern, which serves to define the location and shape of pockets. The pockets in these fabrics are shown as the darkened areas in FIGS. 19 and 22. These pockets are of such shape and depth that the bulk that can go therein is limited to less than a desired amount.

What is needed in the art is a structured forming fabric that will provide increased caliper, bulk and absorbency in tissue and toweling formed thereon.

SUMMARY OF THE INVENTION

The present invention provides a method of producing a structured fibrous web having a high basis weight pillow area of low density on a paper machine using a woven structured fabric.

The present invention consists in one form of a fabric for use by a papermaking machine, the fabric including a plurality of weft yarns, a plurality of warp yarns, and a woven fabric resulting from a repeating pattern of the weft yarns and warp yarns. Each of the weft yarn in the repeating pattern having a sequence of starting at a starting point then sequentially going over three adjacent warp yarns, under one warp yarn, over one warp yarn, under three warp yarns, over one warp yarn and under one warp yarn, the sequence then repeating.

An advantage of the present invention is that the forming fabric has pockets formed by warp yarns that float over three cross-directional yarns and weft floats over three machine direction yarns for the manufacture of bulky tissue.

Another advantage of the present invention is that it creates an improved surface area on a bulky tissue sheet and improved machine performance in making the tissue sheet.

Yet another advantage of the present invention is the perfect formation with high density pillow areas using the ATMOS™ concept, where the forming of the sheet takes place on the structured fabric.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
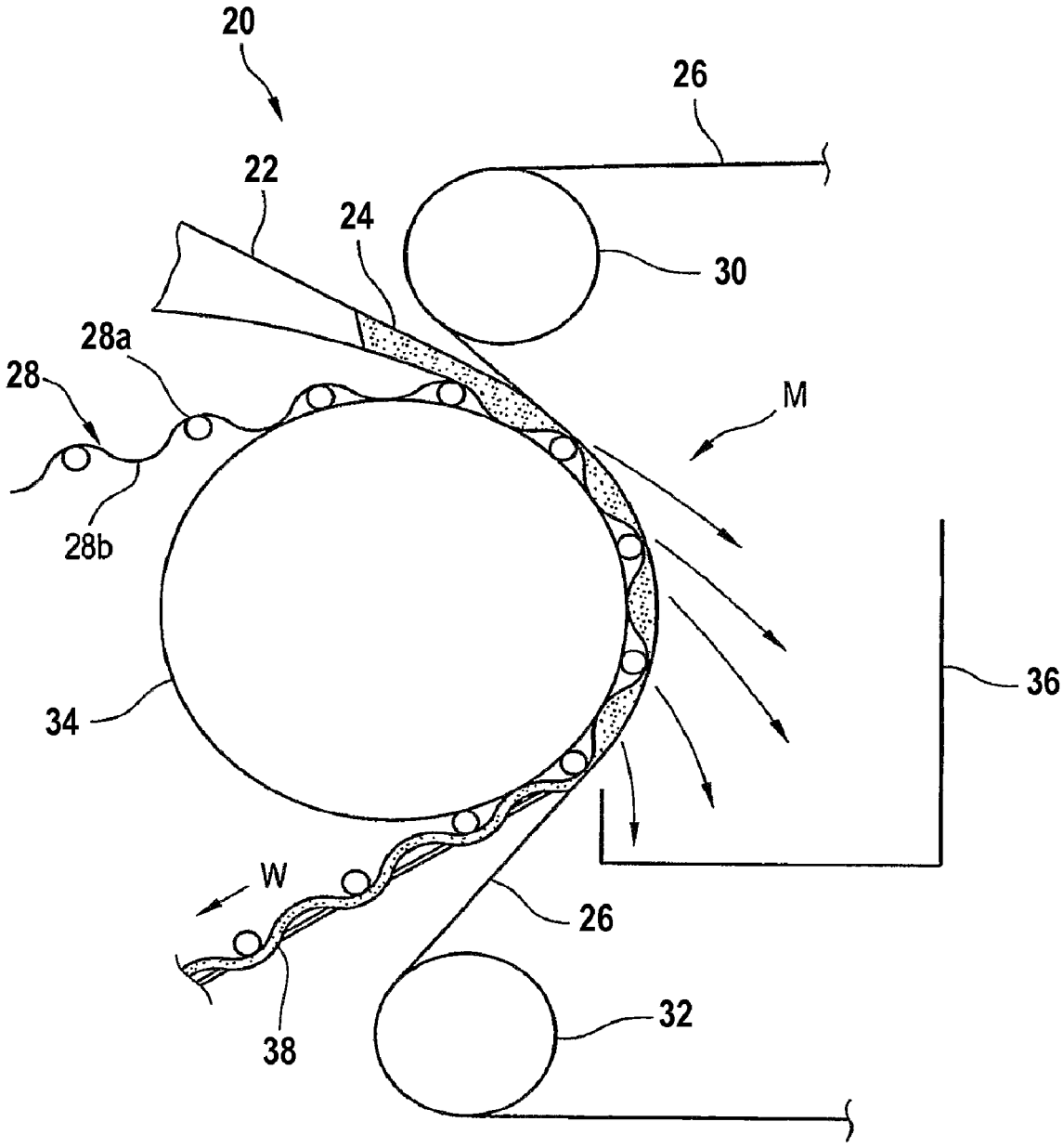
FIG. 1 is a cross-sectional schematic diagram illustrating the formation of a structured web using an embodiment of a method of the present invention.

Referring now to the drawings, and more particularly to FIG. 1, there is a fibrous web machine 20 including a headbox 22 that discharges a fibrous slurry 24 between a forming fabric 26 and a structured fabric 28. Rollers 30 and 32 direct fabric 26 in such a manner that tension is applied thereto, against slurry 24 and structured fabric 28. Structured fabric 28 is supported by forming roll 34 which rotates with a surface speed that matches the speed of structured fabric 28 and forming fabric 26. Structured fabric 28 has peaks 28*a* and valleys 28*b*, which give a corresponding structure to web 38 formed thereon. Structured fabric 28 travels in direction W, and as moisture M is driven from fibrous slurry 24, structured fibrous web 38 takes form. Moisture M that leaves slurry 24 travels through forming fabric 26 and is collected in save-all 36. Fibers in fibrous slurry 24 collect predominately in valleys 28*b* as web 38 takes form.

Structured fabric 28 includes warp and weft yarns interwoven on a textile loom. Structured fabric 28 may be woven flat or in an endless form. The final mesh count of structured fabric 28 lies between 95×120 and 26×20. For the manufacture of toilet tissue, the preferred mesh count is 51×36 or higher and more preferably 58×44 or higher. For the manufacturer of paper towels, the preferred mesh count is 42×31 or lower, and more preferably 36×30 or lower. Structured fabric 28 may have a repeated pattern of 4 shed and above repeats, preferably 5 shed or greater repeats. The warp yarns of structured fabric 28 have diameters of between 0.12 mm and 0.70 mm, and weft yarns have diameters of between 0.15 mm and 0.60 mm. The pocket depth, which is the offset between peak 28*a* and valley 28*b* is between approximately 0.07 mm and 0.60 mm. Yarns utilized in structured fabric 28 may be of any cross-sectional shape, for example, round, oval or flat. The yarns of structured fabric 28 can be made of thermoplastic or thermoset polymeric materials of any color. The surface of structured fabric 28 can be treated to provide a desired surface energy, thermal resistance, abrasion resistance and/or hydrolysis resistance. A printed design, such as a screen printed design, of polymeric material can be applied to structured fabric 28 to enhance its ability to impart an aesthetic pattern into web 38 or to enhance the quality of web 38. Such a design may be in the form of an elastomeric cast structure similar to the Spectra® membrane described in another patent application. Structured fabric 28 has a top surface plane contact area at peak 28*a* of 10% or higher, preferably 20% or higher, and more preferably 30% depending upon the particular product being made. The contact area on structured web 28 at peak 28*a* can be increased by abrading the top surface of structured fabric 28 or an elastomeric cast structure can be formed thereon having a flat top surface. The top surface may also be hot calendered to increase the flatness.

Forming roll 34 is preferably solid. Moisture travels through forming fiber 26 but not through structured fabric 28. This advantageously forms structured fibrous web 38 into a more bulky or absorbent web than the prior art.

Figure 2:
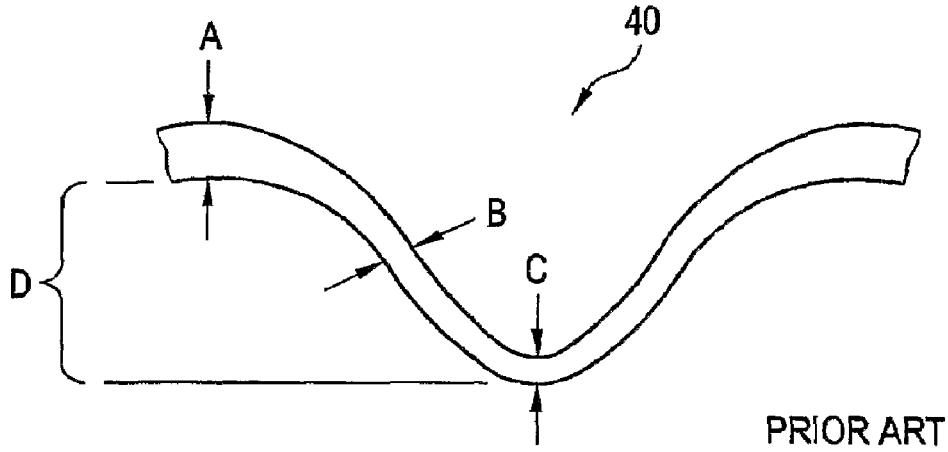
FIG. 2 is a cross-sectional view of a portion of a structured web of a prior art method.

Prior art methods of moisture removal, remove moisture through a structured fabric by way of negative pressure. It results in a cross-sectional view as seen in FIG. 2. Prior art structured web 40 has a pocket depth D which corresponds to the dimensional difference between a valley and a peak. The valley occurring at the point where measurement C occurs and the peak occurring at the point where measurement A is taken. A top surface thickness A is formed in the prior art method. Sidewall dimension B and pillow thickness C of the prior art result from moisture drawn through a structured fabric. Dimension B is less than dimension A and dimension C is less than dimension B in the prior art structure.

Figure 3:
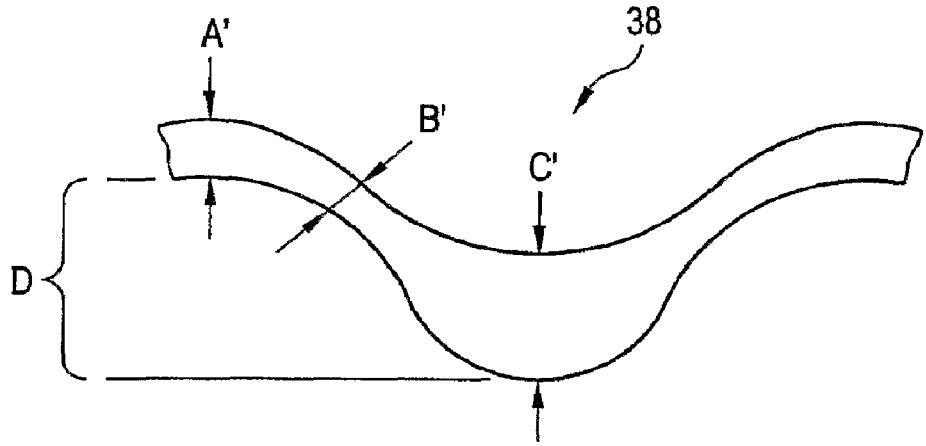
FIG. 3 is a cross-sectional view of a portion of the structured web of an embodiment of the present invention as made on the machine of FIG. 1.
Figure 4:
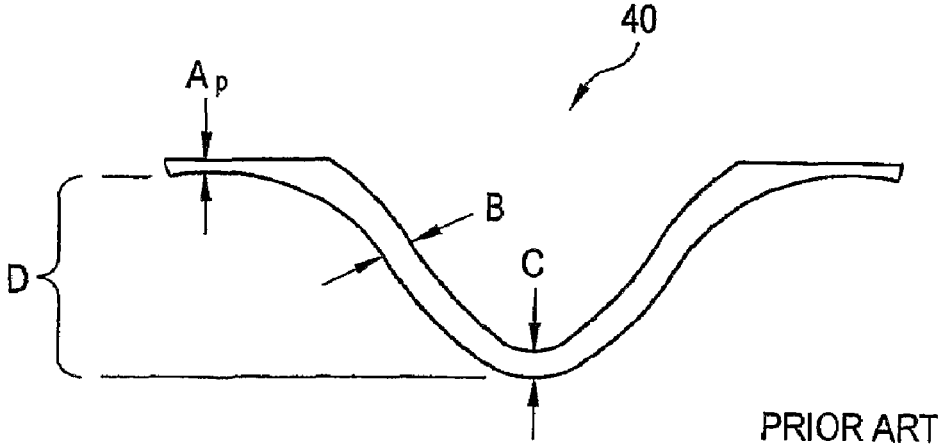
FIG. 4 illustrates the web portion of FIG. 2 having subsequently gone through a press drying operation.
Figure 5:
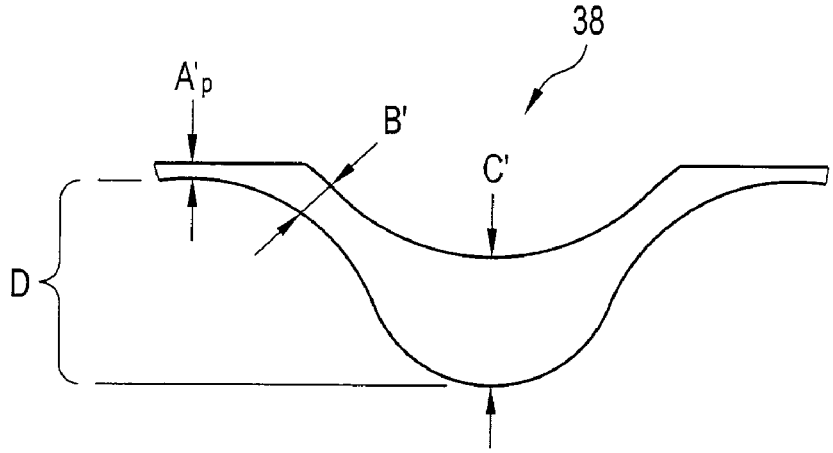
FIG. 5 illustrates a portion of the fiber web of the present invention of FIG. 3 having subsequently gone through a press drying operation.

In contrast, structured web 38, as illustrated in FIGS. 3 and 5, have for discussion purposes, a pocket depth D that is similar to the prior art. However, sidewall thickness B' and pillow thickness C' exceed the comparable dimensions of web 40. This advantageously results from the forming of structural web 38 on structured fabric 28 at low consistency and the removal of moisture is an opposite direction from the prior art. This results in a thicker pillow dimension C'. Even after fiber web 38 goes through a drying press operation, as illustrated in FIG. 5, dimension C' is substantially greater than $A_p$'. Advantageously, the fiber web resulting from the present invention has a higher basis weight in the pillow areas as compared to prior art. Also, the fiber to fiber bonds are not broken as they can be in impression operations, which expand the web into the valleys.

According to prior art an already formed web is vacuum transferred into a structured fabric. The sheet must then expand to fill the contour of the structured fabric. In doing so, fibers must move apart. Thus the basis weight is lower in these pillow areas and therefore the thickness is less than the sheet at point A.

Now, referring to FIGS. 6 to 11 the process will be explained by simplified schematic drawings.

Figure 6:
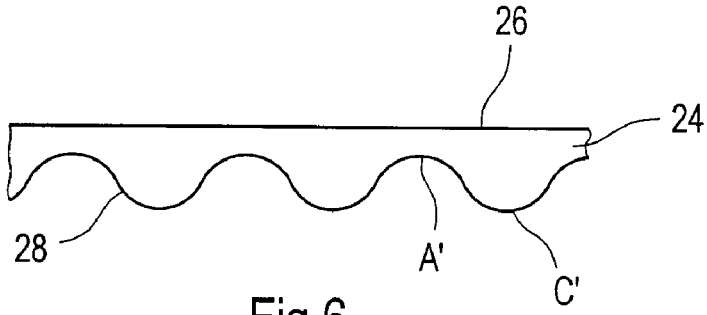
FIG. 6 illustrates a resulting fiber web of the forming section of the present invention.
Figure 8:
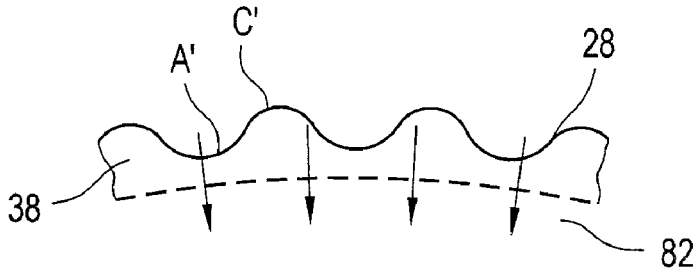
FIG. 8 illustrates the moisture removal of the fiber web of the present invention.

As shown in FIG. 6, fibrous slurry 24 is formed into a web 38 with a structure inherent in the shape of structured fabric 28. Forming fabric 26 is porous and allows moisture to escape during forming. Further, water is removed as shown in FIG. 8, through dewatering fabric 82. The removal of moisture through fabric 82 does not cause a compression of pillow areas C' in the forming web, since pillow areas C' reside in the structure of structured fabric 28.

Figure 7:
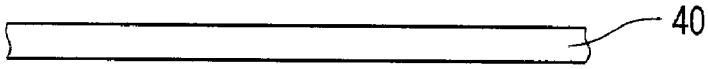
PRIOR ART Fig.7
FIG. 7 illustrates the resulting fiber web of the forming section of a prior art method.

The prior art web shown in FIG. 7, is formed with a conventional forming fabric as between two conventional forming fabrics in a twin wire former and is characterized by a flat uniform surface. It is this fiber web that is given a three-dimensional structure by a wet shaping stage, which results in the fiber web that is shown in FIG. 2. A conventional tissue machine that employs a conventional press fabric will have a contact area approaching 100%. Normal contact area of the structured fiber, as in this present invention, or as on a TAD machine, is typically much lower than that of a conventional machine, it is in the range of 15 to 35% depending on the particular pattern of the product being made.

Figure 9:
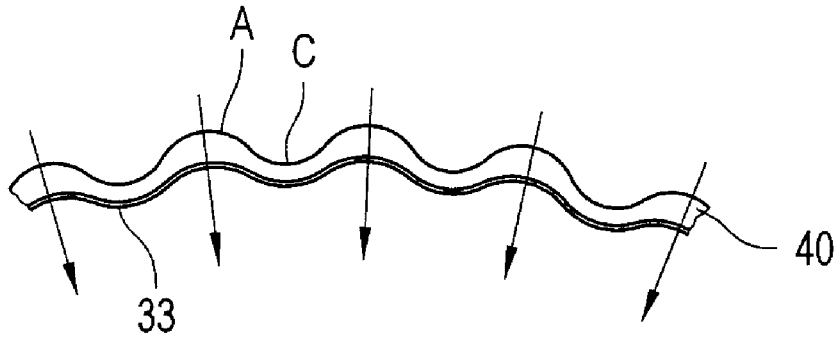
Fig.9 PRIOR ART
FIG. 9 illustrates the moisture removal of the fiber web of a prior art structured web.
Figure 10:
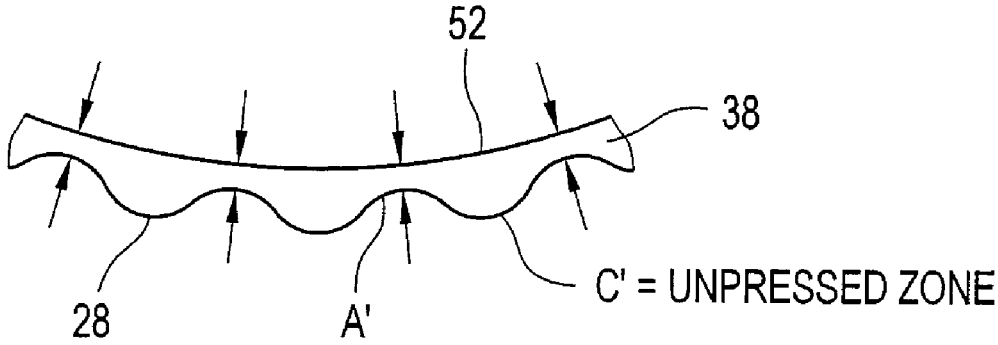
FIG. 10 illustrates the pressing points on a fiber web of the present invention.
Figure 11:
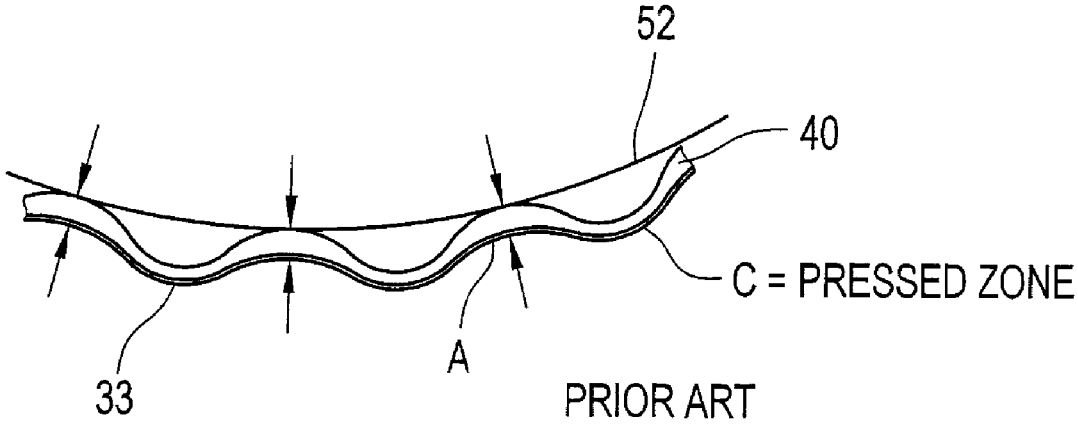
PRIOR ART Fig.11
FIG. 11 illustrates pressing points of prior art structured web.

In FIGS. 9 and 11 a prior art web structure is shown where moisture is drawn through a structured fabric 33 causing the web, as shown in FIG. 7, to be shaped and causing pillow area C to have a low basis weight as the fibers in the web are drawn into the structure. The shaping can be done by performing pressure or underpressure to the web 40 forcing the web to follow the structure of the structured fabric 33. This additionally causes fiber tearing as they are moved into pillow area C. Subsequent pressing at the Yankee dryer 52, as shown in FIG. 11, further reduces the basis weight in area C. In contrast, water is drawn through dewatering fabric 82 in the present invention, as shown in FIG. 8, preserving pillow areas C'. Pillow areas C' of FIG. 10, is an unpressed zone, which is supported on structured fabric 28, while pressed against Yankee 52. Pressed zone A' is the area through which most of the pressure applied is transferred. Pillow area C' has a higher basis weight than that of the illustrated prior art structures.

The increased mass ratio of the present invention, particularly the higher basis weight in the pillow areas carries more water than the compressed areas, resulting in at least two positive aspects of the present invention over the prior art, as illustrated in FIGS. 10 and 11. First, it allows for a good transfer of the web to the Yankee surface 52, since the web has a relatively lower basis weight in the portion that comes in contact with the Yankee surface 52, at a lower overall sheet solid content than had been previously attainable, because of the lower mass of fibers that comes in contact with the Yankee dryer 52. The lower basis weight means that less water is carried to the contact points with the Yankee dryer 52. The compressed areas are dryer than the pillow areas, thereby allowing an overall transfer of the web to another surface, such as a Yankee dryer 52, with a lower overall web solids content. Secondly, the construct allows for the use of higher temperatures in the Yankee hood 54 without scorching or burning of the pillow areas, which occurs in the prior art pillow areas. The Yankee hood 54 temperatures are often greater than 350° C. and preferably greater than 450° C. and even more preferably greater than 550° C. As a result the present invention can operate at lower average pre-Yankee press solids than the prior art, making more full use of the capacity of the Yankee Hood drying system. The present invention can allows the solids content of web 38 prior to the Yankee dryer to run at less than 40%, less than 35% and even as low as 25%.

Due to the formation of the web 38 with the structured fabric 28 the pockets of the fabric 28 are fully filled with fibers.

Therefore, at the Yankee surface 52 the web 38 has a much higher contact area, up to approx. 100%, as compared to the prior art because the web 38 on the side contacting the Yankee surface 52 is almost flat. At the same time the pillow areas C' of the web 38 maintain unpressed, because they are protected by the valleys of the structured fabric 28 (FIG. 10). Good results in drying efficiency were obtained only pressing 25% of the web.

As can be seen in FIG. 11 the contact area of the prior art web 40 to the Yankee surface 52 is much lower as compared to the one of the web 38 manufactured according to the invention.

The lower contact area of the prior art web 40 results from the shaping of the web 40 that now follows the structure of the structured fabric 33.

Due to the less contact area of the prior art web 40 to the Yankee surface 52 the drying efficiency is less.

Figure 12:
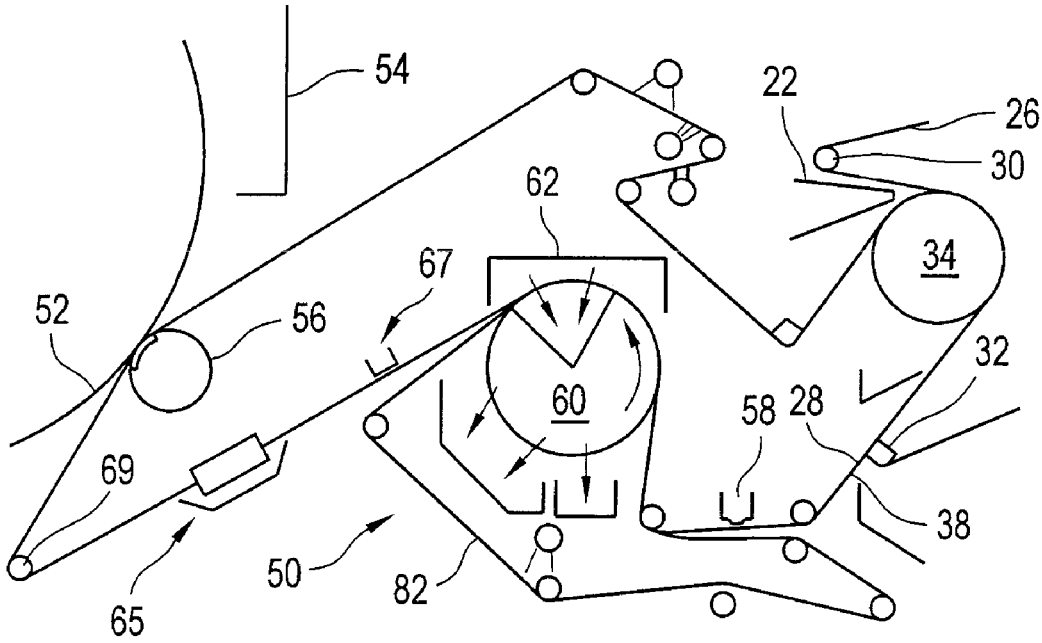
FIG. 12 illustrates a schematical cross-sectional view of an embodiment of a papermaking machine of the present invention.

Now, additionally referring to FIG. 12, there is shown an embodiment of the process where a structured fiber web 38 is formed. Structured fabric 28 carries a three dimensional structured web 38 to an advanced dewatering system 50, past suction box 67 and then to a Yankee roll 52 where the web is transferred to Yankee roll 52 and hood section 54 for additional drying and creping before winding up on a reel (not shown).

A shoe press 56 is placed adjacent to structured fabric 28, holding it in a position proximate Yankee roll 52. Structured web 38 comes into contact with Yankee roll 52 and transfers to a surface thereof, for further drying and subsequent creping.

A vacuum box 58 is placed adjacent to structured fabric 28 to achieve a solids level of 15-25% on a nominal 20 gsm web running at −0.2 to −0.8 bar vacuum with a preferred operating level of −0.4 to −0.6 bar. Vacuum box 58 is a differential pressure arrangement 58 that provides for a pressure differential as it acts on fabric 28, web 38, and fabric 82. Web 38, which is carried by structured fabric 28, contacts dewatering fabric 82 and proceeds toward vacuum roll 60. Vacuum roll 60 is a supporting structure 60 having a support surface. Vacuum roll 60 operates at a vacuum level of −0.2 to −0.8 bar with a preferred operating level of at least −0.4 bar. Hot air hood 62 is optionally fit over vacuum roll 60 to improve dewatering. If for example, a commercial Yankee drying cylinder with 44 mm steel thickness and a conventional hood with an air blowing speed of 145 m/s is used production speeds of 1400 mlmin or more for towel paper and 1700 mlmin or more for toilet paper are used.

Optionally a steam box can be installed instead of the hood 62 supplying steam to the web 38. Preferably the steam box has a sectionalized design to influence the moisture re-dryness cross profile of the web 38. The length of the vacuum zone inside the vacuum roll 60 can be from 200 mm to 2,500 mm, with a preferable length of 300 mm to 1,200 mm and an even more preferable length of between 400 mm to 800 mm. The solids level of web 38 leaving suction roll 60 is 25% to 55% depending on installed options. A vacuum box 67 and hot air supply 65 can be used to increase web 38 solids after vacuum roll 60 and prior to Yankee roll 52. Wire turning roll 69 can also be a suction roll with a hot air supply hood. Roll 56 includes a shoe press with a shoe width of 80 mm or higher, preferably 120 mm or higher, with a maximum peak pressure of less than 2.5 MPa. To create an even longer nip to facilitate the transfer of web 38 to Yankee 52, web 38 carried on structured fabric 28 can be brought into contact with the surface of Yankee roll 52 prior to the press nip associated with shoe press 56. Further, the contact can be maintained after structured fabric 28 travels beyond press 56.

Dewatering fabric 82 may have a permeable woven base fabric connected to a batt layer. The base fabric includes machine direction yarns and cross-directional yarns. The machine direction yarn is a 3 ply multifilament twisted yarn. The cross-direction yarn is a monofilament yarn. The machine direction yarn can also be a monofilament yarn and the construction can be of a typical multilayer design. In either case, the base fabric is needled with a fine batt fiber having a weight of less than or equal to 700 gsm, preferably less than or equal to 150 gsm and more preferably less than or equal to 135 gsm. The batt fiber encapsulates the base structure giving it sufficient stability. The needling process can be such that straight through channels are created. The sheet contacting surface is heated to improve its surface smoothness s. The cross-sectional area of the machine direction yarns is larger than the cross-sectional area of the cross-direction yarns. The machine direction yarn is a multifilament yarn that may include thousands of fibers. The base fabric is connected to a batt layer by a needling process that results in straight through drainage channels.

In another embodiment of dewatering fabric 82 there is included a fabric layer, at least two batt layers, an anti-rewetting layer and an adhesive. The base fabric is substantially similar to the previous description. At least one of the batt layers include a low melt bi-compound fiber to supplement fiber to fiber bonding upon heating. On one side of the base fabric, there is attached an anti-rewetting layer, which may be attached to the base fabric by an adhesive, a melting process or needling wherein the material contained in the anti-rewet layer is connected to the base fabric layer and a batt layer. The anti-rewetting layer is made of an elastomeric material thereby forming elastomeric membrane, which has openings therethrough.

The batt layers are needled to thereby hold dewatering fabric 82 together. This advantageously leaves the batt layers with many needled holes therethrough. The anti-rewetting layer is porous having water channels or straight through pores therethrough.

In yet an other embodiment of dewatering fabric 82, there is a construct substantially similar to that previously discussed with an addition of a hydrophobic layer to at least one side of de-watering fabric 82. The hydrophobic layer does not absorb water, but it does direct water through pores therein.

In yet another embodiment of dewatering fabric 82, the base fabric has attached thereto a lattice grid made of a polymer, such as polyurethane, that is put on top of the base fabric. The grid may be put on to the base fabric by utilizing various known procedures, such as, for example, an extrusion technique or a screen-printing technique. The lattice grid may be put on the base fabric with an angular orientation relative to the machine direction yarns and the cross direction yarns. Although this orientation is such that no part of the lattice is aligned with the machine direction yarns, other orientations can also be utilized. The lattice can have a uniform grid pattern, which can be discontinuous in part. Further, the material between the interconnections of the lattice structure may take a circuitous path rather than being substantially straight. The lattice grid is made of a synthetic, such as a polymer or specifically a polyurethane, which attaches itself to the base fabric by its natural adhesion properties.

In yet another embodiment of dewatering fabric 82 there is included a permeable base fabric having machine direction yarns and cross-direction yarns, that are adhered to a grid. The grid is made of a composite material the may be the same as that discussed relative to a previous embodiment of dewatering fabric 82. The grid includes machine direction yarns with a composite material formed therearound. The grid is a composite structure formed of composite material and machine direction yarns. The machine direction yarns may be precoated with a composite before being placed in rows that are substantially parallel in a mold that is used to reheat the composite material causing it to re-flow into a pattern. Additional composite material may be put into the mold as well. The grid structure, also known as a composite layer, is then connected to the base fabric by one of many techniques including laminating the grid to the permeable fabric, melting the composite coated yarn as it is held in position against the permeable fabric or by re-melting the grid onto the base fabric. Additionally, an adhesive may be utilized to attach the grid to permeable fabric.

The batt fiber may include two layers, an upper and a lower layer. The batt fiber is needled into the base fabric and the composite layer, thereby forming a dewatering fabric 82 having at least one outer batt layer surface. Batt material is porous by its nature, additionally the needling process not only connects the layers together, it also creates numerous small porous cavities extending into or completely through the structure of dewatering fabric 82.

Dewatering fabric 82 has an air permeability of from 5 to 100 cubic feet/minute preferably 19 cubic feet/minute or higher and more preferably 35 cubic feet/minute or higher. Mean pore diameters in dewatering fabric 82 are from 5 to 75 microns, preferably 25 microns or higher and more preferably 35 microns or higher. The hydrophobic layers can be made from a synthetic polymeric material, a wool or a polyamide, for example, nylon 6. The anti-rewet layer and the composite layer may be made of a thin elastomeric permeable membrane made from a synthetic polymeric material or a polyamide that is laminated to the base fabric.

The batt fiber layers are made from fibers ranging from 0.5 d-tex to 22 d-tex and may contain a low melt bi-compound fiber to supplement fiber to fiber bonding in each of the layers upon heating. The bonding may result from the use of a low temperature meltable fiber, particles and/or resin. The dewatering fabric can be less than 2.0 millimeters, or less than 1.50 millimeters, or less than 1.25 millimeters or less than 1.0 millimeter thick.

Preferred embodiments of the dewatering fabric 82 are also described in the PCT/EP2004/053688 and PCT/EP2005/050198 which are herewith incorporated by reference.

Figure 13:
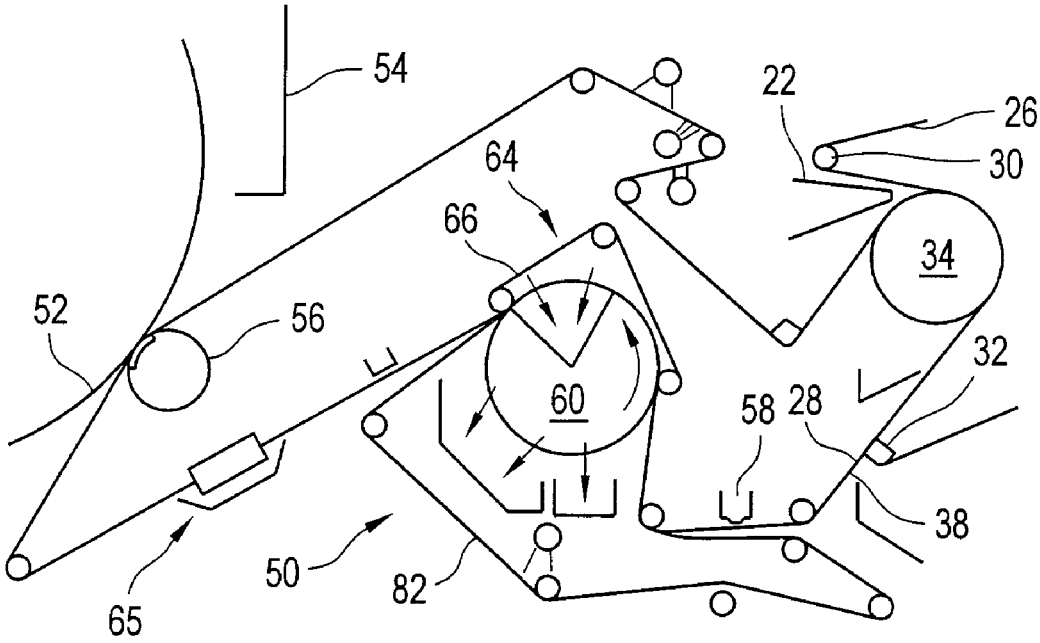
FIG. 13 illustrates a schematical cross-sectional view of another embodiment of a papermaking machine of the present invention.

Now, additionally referring to FIG. 13, there is shown yet another embodiment of the present invention, which is substantially similar to the invention illustrated in FIG. 12, except that instead of hot air hood 62, there is a belt press 64. Belt press 64 includes a permeable belt 66 capable of applying pressure to the non-sheet contacting side of structured fabric 28 that carries web 38 around suction roll 60. Belt 66 is also known as a pressure producing element 66. Fabric 66 of belt press 64 is also known as an extended nip press belt or a link fabric, which can run at 60 KN/m fabric tension with a pressing length that is longer than the suction zone of roll 60.

Preferred embodiments of the fabric 66 and the required operation conciliation are also described in PCT/EP2004/053688 and PCT/EP2005/050198 which are herewith incorporated by reference.

The above mentioned references are also fully applicable for dewatering fabrics 82 and press fabrics 66 described in the further embodiments.

While pressure is applied to structured fabric 28, the high fiber density pillow areas in web 38 are protected from that pressure as they are contained within the body of structured fabric 28, as they are in the Yankee nip.

Belt 66 is a specially designed Extended Nip Press Belt 66, made of, for example reinforced polyurethane and/or a spiral link fabric. Belt 66 is permeable thereby allowing air to flow therethrough to enhance the moisture removing capability of belt press 64. Moisture is drawn from web 38 through dewatering fabric 82 and into vacuum roll 60.

Belt 66 provides a low level of pressing in the range of 50-300 KPa and preferably greater than 100 KPa. This allows a suction roll with a 1.2 meter diameter to have a fabric tension of greater than 30 KN/m and preferably greater than 60 KN/m. The pressing length of permeable belt 66 against fabric 28, which is indirectly supported by vacuum roll 60, is at least as long as a suction zone in roll 60. Although the contact portion of belt 66 can be shorter than the suction zone.

Permeable belt 66 has a pattern of holes therethrough, which may, for example, be drilled, laser cut, etched formed or woven therein. Permeable belt 66 may be monoplanar without grooves. In one embodiment, the surface of belt 66 has grooves and is placed in contact with fabric 28 along a portion of the travel of permeable belt 66 in belt press 64. Each groove connects with a set of the holes to allow the passage and distribution of air in belt 66. Air is distributed along the grooves, which constitutes an open area adjacent to contact areas, where the surface of belt 66 applies pressure against web 38. Air enters permeable belt 66 through the holes and then migrates along the grooves, passing through fabric 28, web 38 and fabric 82. The diameter of the holes may be larger than the width of the grooves. The grooves may have a cross-section contour that is generally rectangular, triangular, trapezoidal, semi-circular or semi-elliptical. The combination of permeable belt 66, associated with vacuum roll 60, is a combination that has been shown to increase sheet solids by at least 15%.

An example of another structure of belt 66 is that of a thin spiral link fabric, which can be a reinforcing structure within belt 66 or the spiral link fabric will itself serve as belt 66. Within fabric 28 there is a three dimensional structure that is reflected in web 38. Web 38 has thicker pillow areas, which are protected during pressing as they are within the body of structured fabric 28. As such the pressing imparted by belt press assembly 64 upon web 38 does not negatively impact web quality, while it increases the dewatering rate of vacuum roll 60.

Figure 14:
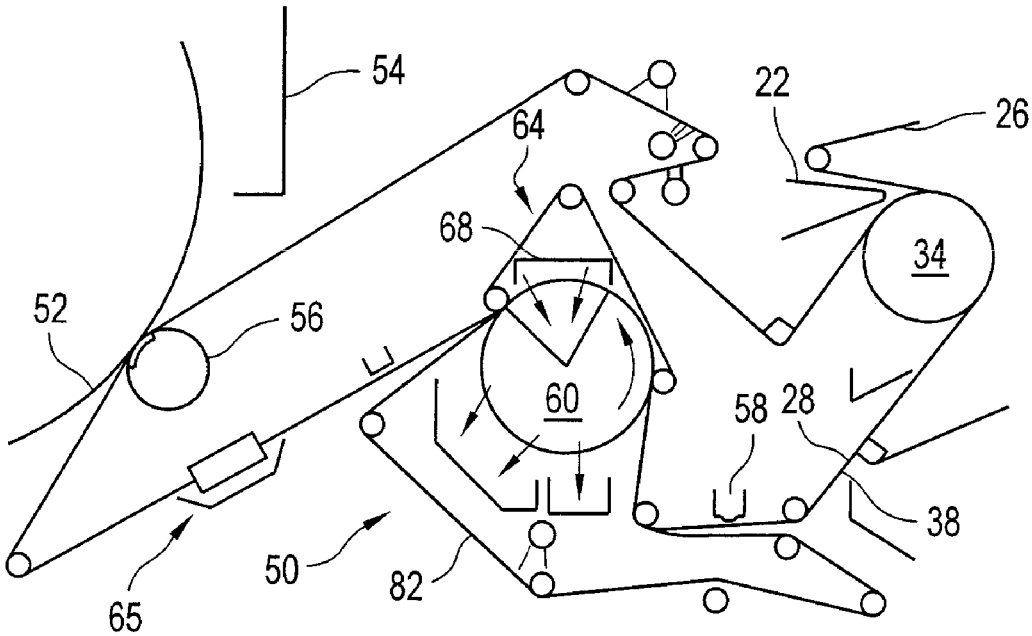
FIG. 14 illustrates a schematical cross-sectional view of another embodiment of a papermaking machine of the present invention.

Now, additionally referring to FIG. 14, which is substantially similar to the embodiment shown in FIG. 13 with the addition of hot air hood 68 placed inside of belt press 64 to enhance the dewatering capability of belt press 64 in conjunction with vacuum roll 60.

Figure 15:
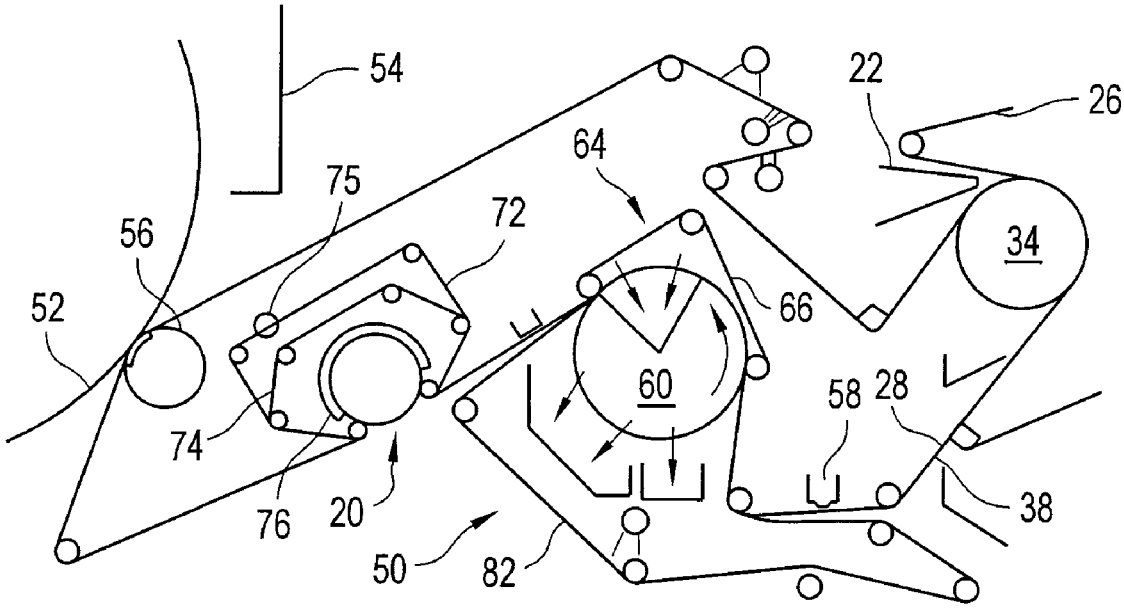
FIG. 15 illustrates a schematical cross-sectional view of another embodiment of a papermaking machine of the present invention.

Now, additionally referring to FIG. 15, there is shown yet another embodiment of the present invention, which is substantially similar to the embodiment shown in FIG. 13, but including a boost dryer 70, which encounters structured fabric 28. Web 38 is subjected to a hot surface of boost driver 70, structure web 38 rides around boost driver 70 with another woven fabric 72 riding on top of structured fabric 28. On top of woven fabric 72 is a thermally conductive fabric 74, which is in contact with both woven fabric 72 and a cooling jacket 76 that applies cooling and pressure to all fabrics and web 38. Here again, the higher fiber density pillow areas in web 38 are protected from the pressure as they are contained within the body of structured fabric 28. As such, the pressing process does not negatively impact web quality. The drying rate of boost dryer 70 is above 400 kg/hrm$^2$ and preferably above 500 kg/hrm$^2$. The concept of boost dryer 70 is to provide sufficient pressure to hold web 38 against the hot surface of the dryer thus preventing blistering. Steam that is formed at the knuckle points fabric 28 passes through fabric 28 and is condensed on fabric 72. Fabric 72 is cooled by fabric 74 that is in contact with the cooling jacket, which reduces its temperature to well below that of the steam. Thus the steam is condensed to avoid a pressure build up to thereby avoid blistering of web 38. The condensed water is captured in woven fabric 72, which is dewatered by dewatering device 75. It has been shown that depending on the size of boost dryer 70, the need for vacuum roll 60 can be eliminated. Further, depending upon the size of boost dryer 70, web 38 may be creped on the surface of boost dryer 70, thereby eliminating the need for Yankee dryer 52.

Figure 16:
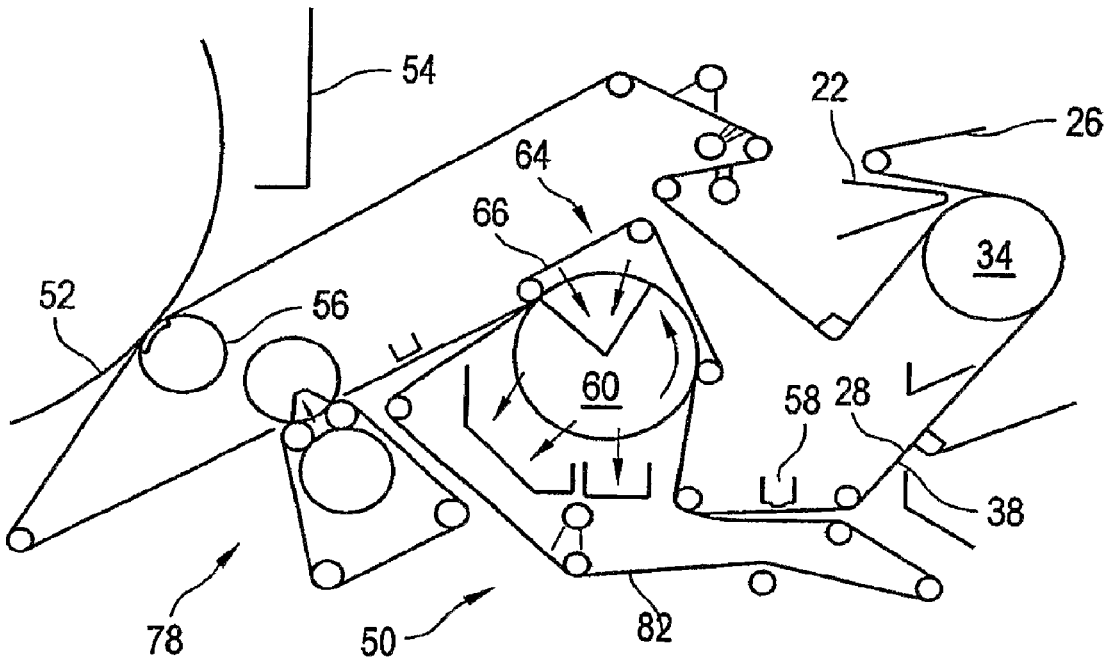
FIG. 16 illustrates a schematical cross-sectional view of another embodiment of a papermaking machine of the present invention.

Now, additionally referring to FIG. 16, there is shown yet another embodiment of the present invention substantially similar to the invention disclosed in FIG. 13 but with an addition of an air press 78, which is a four roll cluster press that is used with high temperature air and is referred to as an HPTAD for additional web drying prior to the transfer of web 38 to Yankee 52. Four roll cluster press 78 includes a main roll and a vented roll and two cap rolls. The purpose of this cluster press is to provide a sealed chamber that is capable of being pressurized. The pressure chamber contains high temperature air, for example, 150° C. or higher and is at a significantly higher pressure than conventional TAD technology, for example, greater than 1.5 psi resulting in a much higher drying rate than a conventional TAD. The high pressure hot air passes through an optional air dispersion fabric, through web 38 and fabric 28 into a vent roll. The air dispersion fabric may prevent web 38 from following one of the four cap rolls. The air dispersion fabric is very open, having a permeability that equals or exceeds that of fabric 28. The drying rate of the HPTAD depends on the solids content of web 38 as it enters the HPTAD. The preferred drying rate is at least 500 kg/hr/m$^2$, which is a rate of at least twice that of conventional TAD machines.

Advantages of the HPTAD process are in the areas of improved sheet dewatering without a significant loss in sheet quality, compactness in size and energy efficiency. Additionally, it enables higher pre-Yankee solids, which increase the speed potential of the invention. Further, the compact size of the HPTAD allows for easy retrofit to an existing machine. The compact size of the HPTAD and the fact that it is a closed system means that it can be easily insulated and optimized as a unit to increase energy efficiency.

Figure 17:
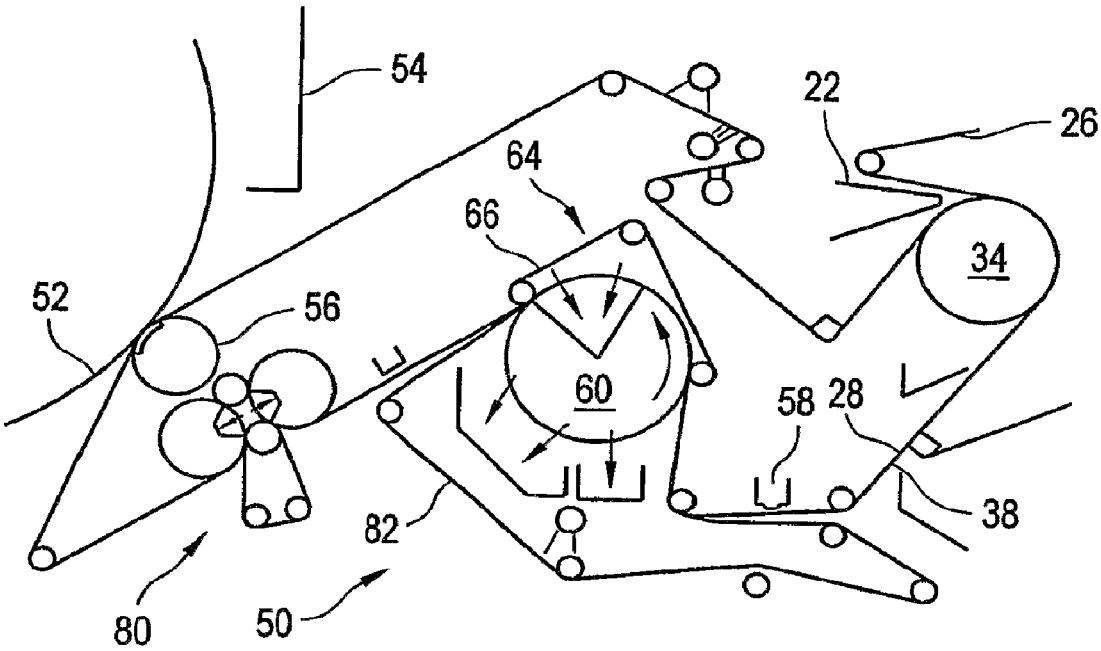
FIG. 17 illustrates a schematical cross-sectional view of another embodiment of a papermaking machine of the present invention.

Now, additionally referring to FIG. 17, there is shown another embodiment of the present invention. This is significantly similar to FIGS. 13 and 16 except for the addition of a two-pass HPTAD 80. In this case, two vented rolls are used to double the dwell time of structured web 38 relative to the design shown in FIG. 16. An optional coarse mesh fabric may used as in the previous embodiment. Hot pressurized air passes through web 38 carried on fabric 28 and onto the two vent rolls. It has been shown that depending on the configuration and size of the HPTAD, that more than one HPTAD can be placed in series, which can eliminate the need for roll 60.

Figure 18:
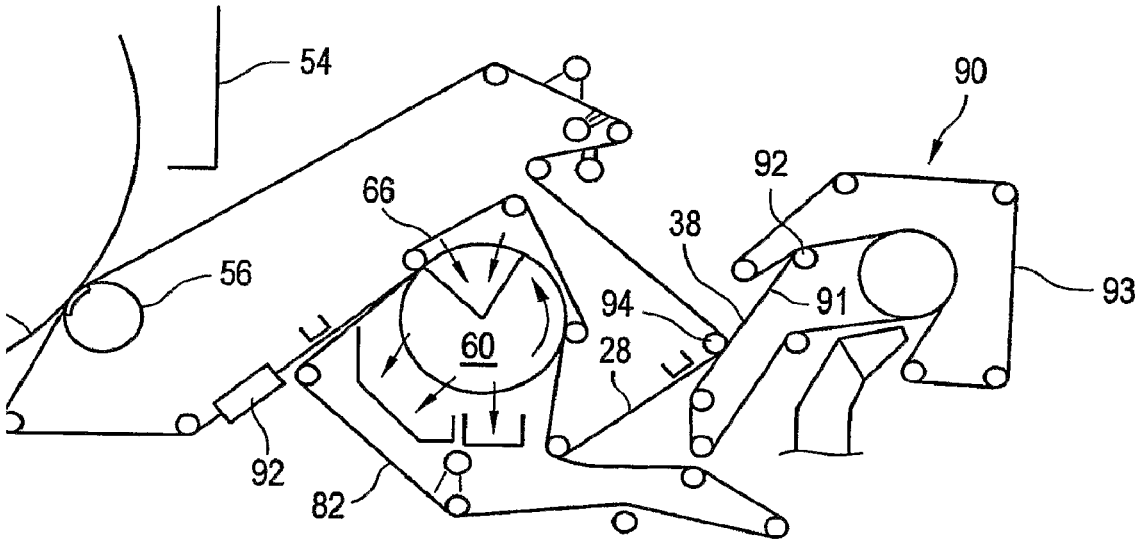
FIG. 18 illustrates a schematical cross-sectional view of another embodiment of a papermaking machine of the present invention.
Figure 19:
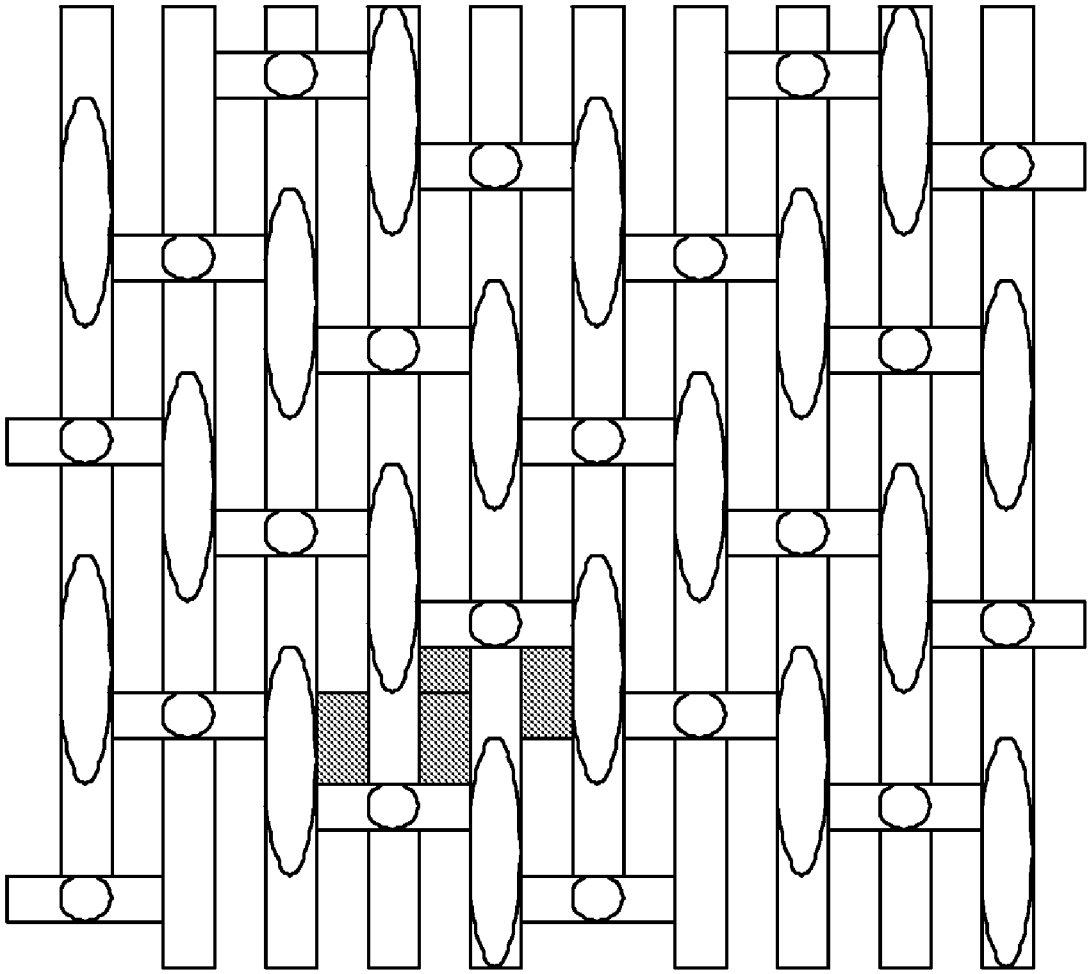
FIG. 19 is a prior art woven fabric known as an M weave fabric.
Figures 20, 21:
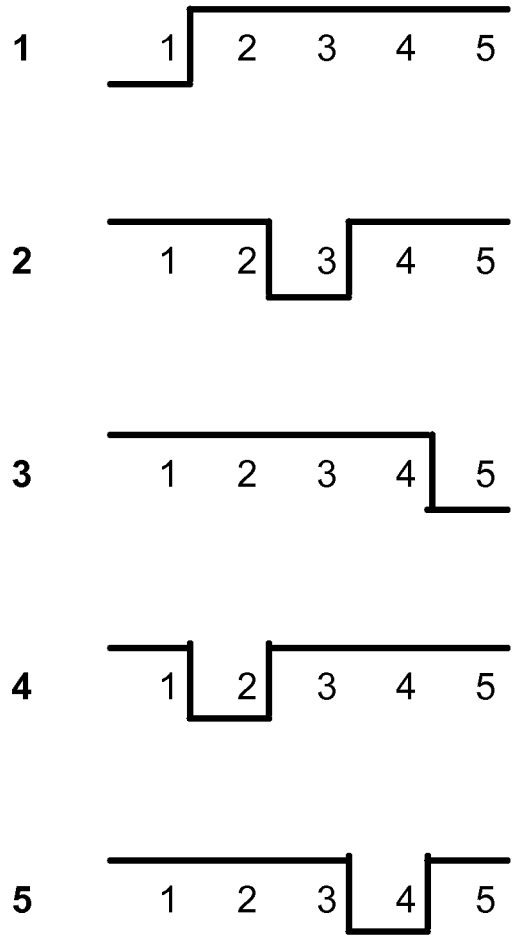
FIG. 20 is a schematical view of the positioning of the weft and warp yarns of the woven fabric of FIG. 19.
FIG. 21 is a schematical representation of the routing of the warp yarns of the woven fabric of FIGS. 19 and 20.
Figure 22:
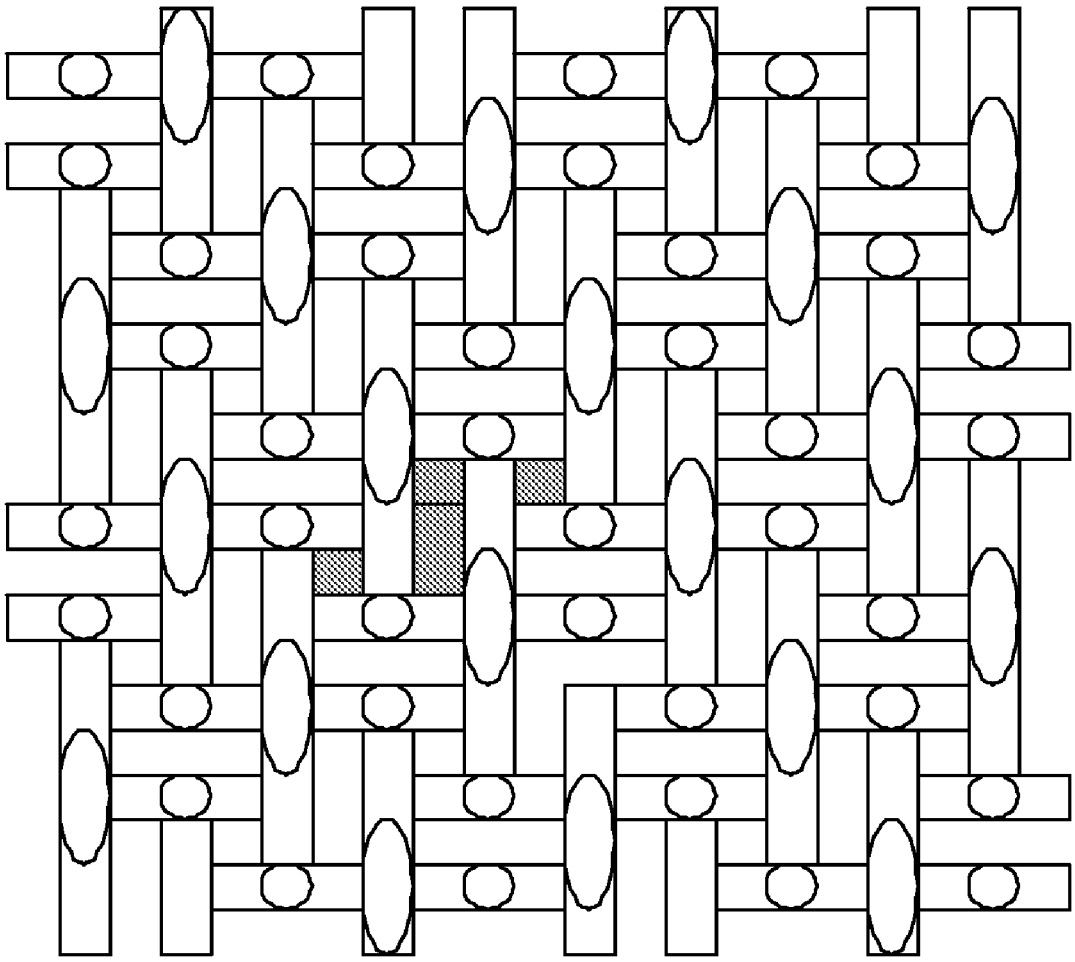
FIG. 22 is a prior art woven fabric known as an G weave fabric.
Figures 23, 24:
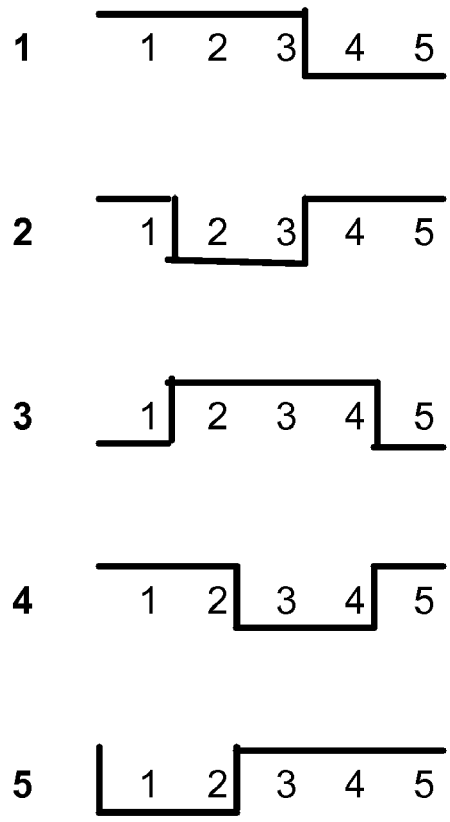
FIG. 23 is a schematical view of the positioning of the weft and warp yarns of the woven fabric of FIG. 22.
FIG. 24 is a schematical representation of the routing of the warp yarns of the woven fabric of FIGS. 22 and 23.

Now, additionally referring to FIG. 18, a conventional Twin Wire Former 90 may be used to replace the Crescent Former shown in previous examples. The forming roll can be either a solid or open roll. If an open roll is used, care must be taken to prevent significant dewatering through the structured fabric to avoid losing basis weight in the pillow areas. The outer forming fabric 93 can be either a standard forming fabric or one such as that disclosed in U.S. Pat. No. 6,237,644. The inner forming fabric 91 must be a structured fabric 91 that is much coarser than the outer forming fabric. A vacuum box 92 may be needed to ensure that the web stays with structured wire 91 and does not go with outer wire 90. Web 38 is transferred to structured fabric 28 using a vacuum device. The transfer can be a stationary vacuum shoe or a vacuum assisted rotating pick-up roll 94. The second structured fabric 28 is at least the same coarseness and preferably courser than first structured fabric 91. The process from this point is the same as one of the previously discussed processes. The registration of the web from the first structured fabric to the second structured fabric is not perfect, as such some pillows will lose some basis weight during the expansion process, thereby losing some of the benefit of the present invention. However, this process option allows for running a differential speed transfer, which has been shown to improve some sheet properties. Any of the arrangements for removing water discussed above as may be used with the Twin Wire Former arrangement and a conventional TAD.

The fiber distribution of web 38 in this invention is opposite that of the prior art, which is a result of removing moisture through the forming fabric and not through the structured fabric. The low density pillow areas are of relatively higher basis weight than the surrounding compressed zones, which is opposite of conventional TAD paper. This allows a high percentage of the fibers to remain uncompressed during the process. The sheet absorbency capacity as measured by the basket method, for a nominal 20 gsm web is equal to or greater than 12 grams water per gram of fiber and often exceeds 15 grams of water per gram fiber. The sheet bulk is equal to or greater than 10 $cm^3$/gm and preferably greater than 13 $cm^3$/gm. The sheet bulk of toilet tissue is expected to be equal to or greater than 13 $cm^3$/gm before calendering.

With the basket method of measuring absorbency, five (5) grams of paper are placed into a basket. The basket containing the paper is then weighted and introduced into a small vessel of water at 20° C. for 60 seconds. After 60 seconds of soak time, the basket is removed from the water and allowed to drain for 60 seconds and then weighted again. The weight difference is then divided by the paper weight to yield the grams of water held per gram of fibers being absorbed and held in the paper.

Web 38 is formed from fibrous slurry 24 that headbox 22 discharges between forming fabric 26 and structured fabric 28. Roll 34 rotates and supports fabrics 26 and 28 as web 38 forms. Moisture M flows through fabric 26 and is captured in save all 36. It is the removal of moisture in this manner that serves to allow pillow areas of web 38 to retain a greater basis weight and therefore thickness than if the moisture were to be removed through structured fabric 28. Sufficient moisture is removed from web 38 to allow fabric 26 to be removed from web 38 to allow web 38 to proceed to a drying stage. Web 38 retains the pattern of structured fabric 28 and any zonal permeability effects from fabric 26 that may be present.

Referring again to FIG. 1, there is shown a papermaking machine 20 including a headbox 22 that discharges a fibrous slurry 24 between forming fabric 26 and a woven structured fabric 28. Rollers 30 and 32 direct fabric 26 in such a manner that tension is applied thereto, against slurry 24 and woven structured fabric 28. Woven structured fabric 28 is supported by forming roll 34, which rotates with a surface speed that matches the speed of woven structured fabric 28 and forming fabric 26. Structured fabric 28 has peaks 28*a* and valleys 28*b*, which give a corresponding structure to web 38 formed thereon. Structured fabric 28 travels in direction W, and as moisture M is driven from fibrous slurry 24, a structured fibrous web 38 takes form. Moisture M leaves slurry 24 travels through forming fabric 26 and is collected in save-all 36. Fibers in fibrous slurry 24 collect predominately in valleys 28*b* as web 38 takes form.

As slurry 24 comes from headbox 22 it has a very low consistency of approximately 0.1 to 0.5%. The consistency of web 38 increases to approximately 7% at the end of the forming section outlet. Structured fabric 28 carries web 38 from where it is first placed there by headbox 22 all of the way to a Yankee dryer to thereby provide a well defined paper structure for maximum bulk and absorbency capacity. Web 38 has exceptional caliper, bulk and absorbency, 30% higher than with a conventional TAD fabric used for producing paper towels. Excellent transfer of web 38 to the Yankee dryer takes place with the ATMOS™ system working at 33 to 37% dryness, which is a higher moisture content than the TAD of 60 to 75%. There is no dryness loss running in the ATMOS™ configuration, since structured fabric 28 has pocket depth (valleys) and not knuckles (peaks) there is no loss of intimacy between a dewatering fabric, web 38, structured fabric 28 and the belt, which is key to reaching the desired dryness with the ATMOS™ system.

Figures 25, 26:
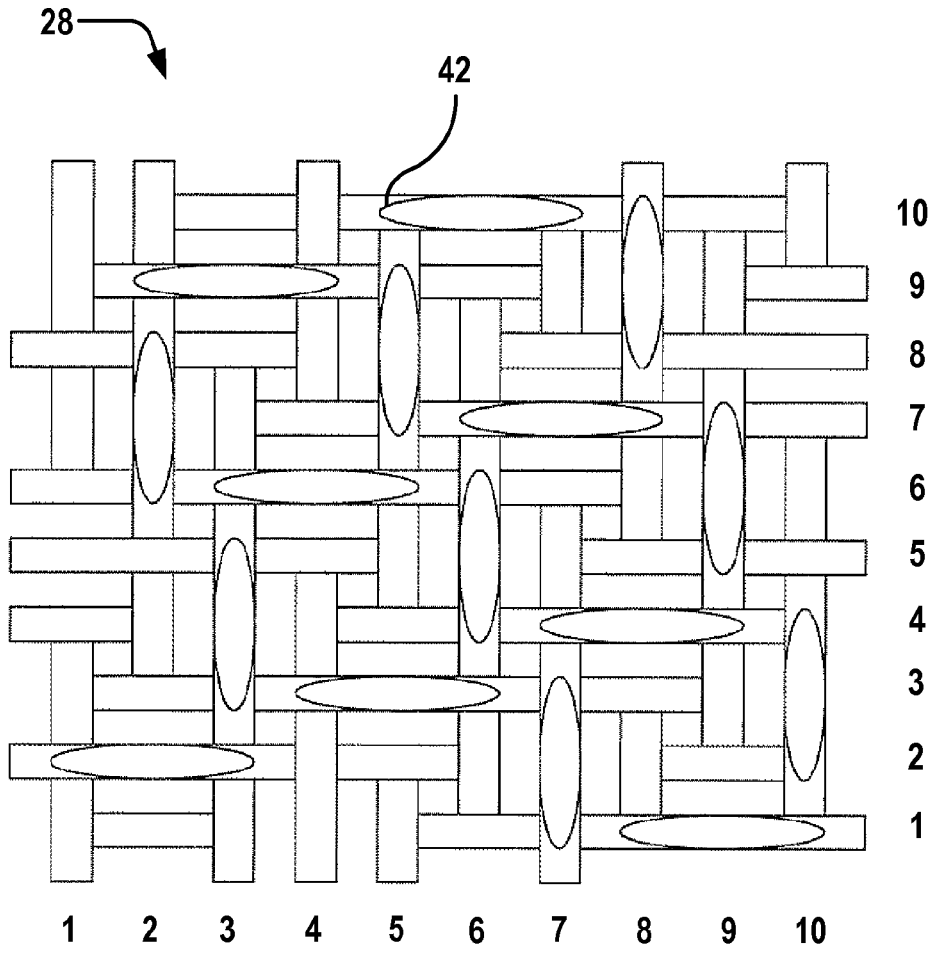
FIG. 25 is an illustration of the weave pattern of the woven fabric of FIG. 1.
FIG. 26 is a schematical view of the warp yarns as they cross the weft yarns of the woven fabric of FIGS. 1 and 25.
Figure 27:
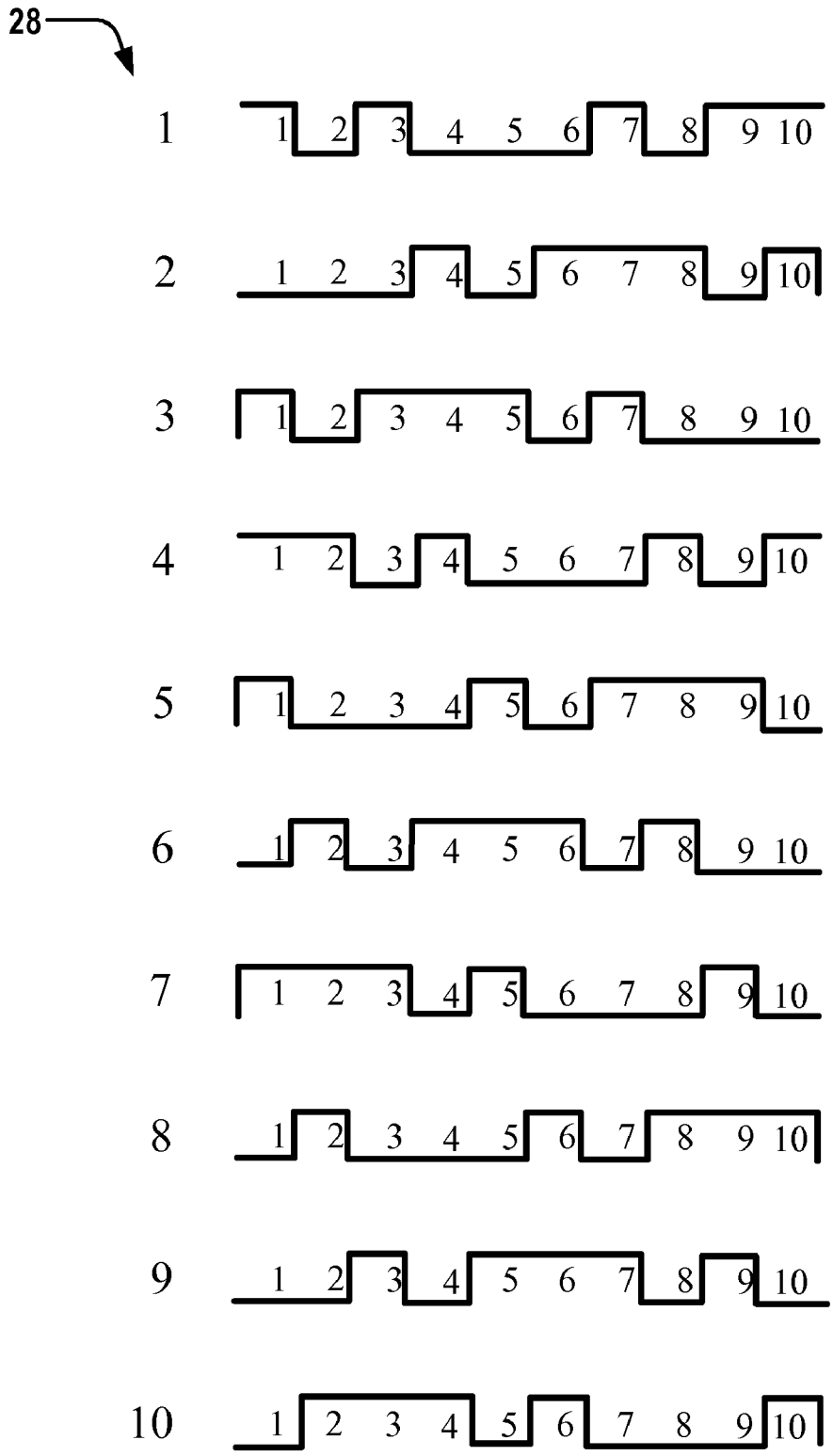
FIG. 27 illustrates a weave pattern of the warp and/or weft yarn of the woven fabric of FIGS. 1 and 25-26.

Now, additionally referring to FIGS. 25-27, woven structured fabric 28 includes warp and weft yarns that are interwoven on a textile loom. Structured fabric 28 may be woven flat or in endless form. Structured fabric 28 has a surface contact area on the web side of 15 to 40%, preferably 25 to 30% and most preferably approximately 28%.

As can be seen in FIGS. 25 and 26, repeating almost square pockets are formed because the weave pattern holds pockets to a deeper depth since there is a plane formed lower than the contact level that substantially surrounds the pocket. The pocket depth, which can be thought of as an offset between peak 28*a* and valley 28*b* occurs substantially across the pocket due to the weave pattern of the present invention. The boundaries of the pockets are shared with part of a boundary of another adjacent pocket formed in woven structured fabric 28. This pocket depth and the size of the pocket leads to a pocket volume. Each pocket has a volume of from 1.0 $mm^3$ to 3.0 $mm^3$, with a preferred volume of between 1.5 $mm^3$ to 2.5 $mm^3$, and a most preferred volume of approximately 2.0 $mm^3$.

Yarns utilized in woven structured fabric 28 may be of any cross-sectional shape, for example, round, oval, flattened or square. Yarns of woven structured fabric 28 can be made of thermoplastic or thermo-set polymeric materials of any color. Surface features 42 may be a flattened, protruding, depressed or other formation on the surface of individual warped and/or weft yarns. Such surface feature 42 may be applied after the weaving of woven structured fabric 28. For example, the top surface may be hot calendared to increase the flatness. The permeability of woven structured fabric 28 is between 300 cfm and 1,600 cfm, with a preferred range of 500 cfm to 1,000 cfm, and a most preferred value of approximately 750 cfm.

The warp yarn pattern shown in FIG. 27 is also reflective of the weft patterns. For example, in FIG. 26 it can be seen that the pattern for warp yarn 1, from top to bottom, is the same as the pattern for weft yarn 3 from left to right. Warp yarn 1 goes over weft yarn 1, under weft yarn 2, over weft yarn 3, under weft yarns 4, 5 and 6, over weft yarn 7, under weft yarn 8 and then over weft yarns 9 and 10. The patterns of the other yarns are described in a like matter from the information in FIGS. 25, 26 and 27.

Woven structured fabric 28 has a repeating pattern that is described by the ten weft and warp yarns of FIGS. 25-27. The fabric can be thought of as having a weave pattern that has offsets from a starting point for the 10 by 10 pattern. Any of the weaves illustrated in FIG. 27 can be selected to demonstrate an offset of the pattern. For example, choosing yarn number 7 as defining a starting point has a zero offset from itself, yarn number 6 is offset by three intersecting yarns to the right, yarn 5 is offset by six positions from the starting position and yarn 4 is offset by nine positions to the right. In a like manner, yarn 3 is offset two, yarn 2 is offset five, yarn 1 is offset eight, yarn 10 is offset one, yarn 9 is offset four and yarn 8 is offset seven. Since the pattern is repeating the offsets can be measured from any of the yarns with a selected yarn being the starting point for the pattern. In a similar fashion, the offsets can be described as a negative offset, which can be thought of as a shift to the left of the pattern. It is noted that adjacent yarns are offset from each other by an odd number of positions from the intersecting yarns. And that the next adjacent yarns are offset by an even number of intersecting yarns. As mentioned previously the weave patterns shown in FIG. 27 are equally applicable to either the weft or the warp directions of the pattern, thereby making the pattern of a symmetrical nature.

The pattern of the weave of the present invention advantageously has a pocket density of from 100 to 300 pockets per square inch and preferably from 150 to 300 pockets per square inch, and a most preferred value of approximately 200 pockets per square inch. Within each 10 by 10 yarn repeating pattern there is at least eight full pockets. The full pockets exist at the intersections of warp yarns 1 and 2 with weft yarns 3 and 4, warp yarns 3 and 4 with weft yarns 7 and 8, warp yarns 4 and 5 with weft yarns 4 and 5, warp yarns 5 and 6 with weft yarns 1 and 2, warp yarns 6 and 7 with weft yarns 8 and 9, warp yarns 7 and 8 with weft yarns 5 and 6, warp yarns 8 and 9 with weft yarns 2 and 3, and warp yarns 9 and 10 with weft yarns 9 and 10. As can be seen in FIGS. 25 and 26 there are also a half pocket along each border of each the four sides of the repeating pattern, which serves to interconnect with a corresponding half of a pocket in the repeating design.

Structured fabric 28 has a surface contact area in the range of 15 to 40%, with a preferred range of 25 to 30% and a most preferred value of approximately 28%. The thickness of structured fabric 28 is in the range of 0.03 to 0.08 inches and preferably 0.04 to 0.06 inches, with a most preferred value of 0.05 inches.

As previously mentioned, the pockets are deeper than those of the prior art because they are on a plane lower than the contact level that surrounds each of these pockets. The use of woven structured fabric 28 with a papermaking machine 20, as illustrated in FIGS. 12-18, is directed to a molding position on an ATMOS™ system, but may also find use on a conventional TAD, a transfer position on an E-TAD or a position on a Metso concept machine.

Figure 28:
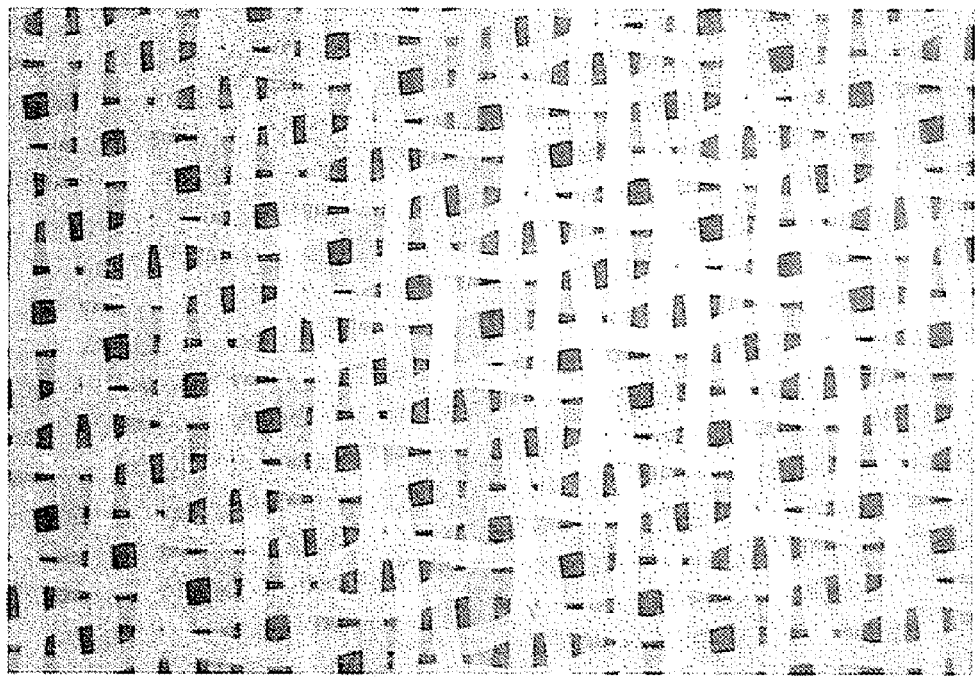
FIG. 28 is a paper side view of the woven fabric of FIGS. 1 and 25-27.
Figure 29:
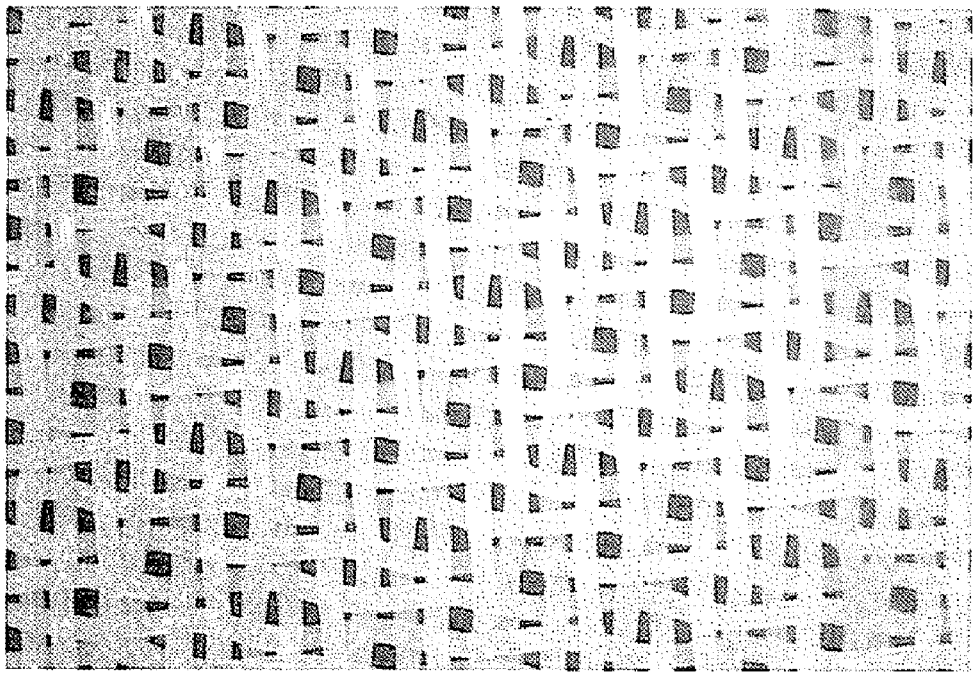
FIG. 29 is an opposite side view of the woven fabric of FIGS. 1 and 25-29.
Figure 30:
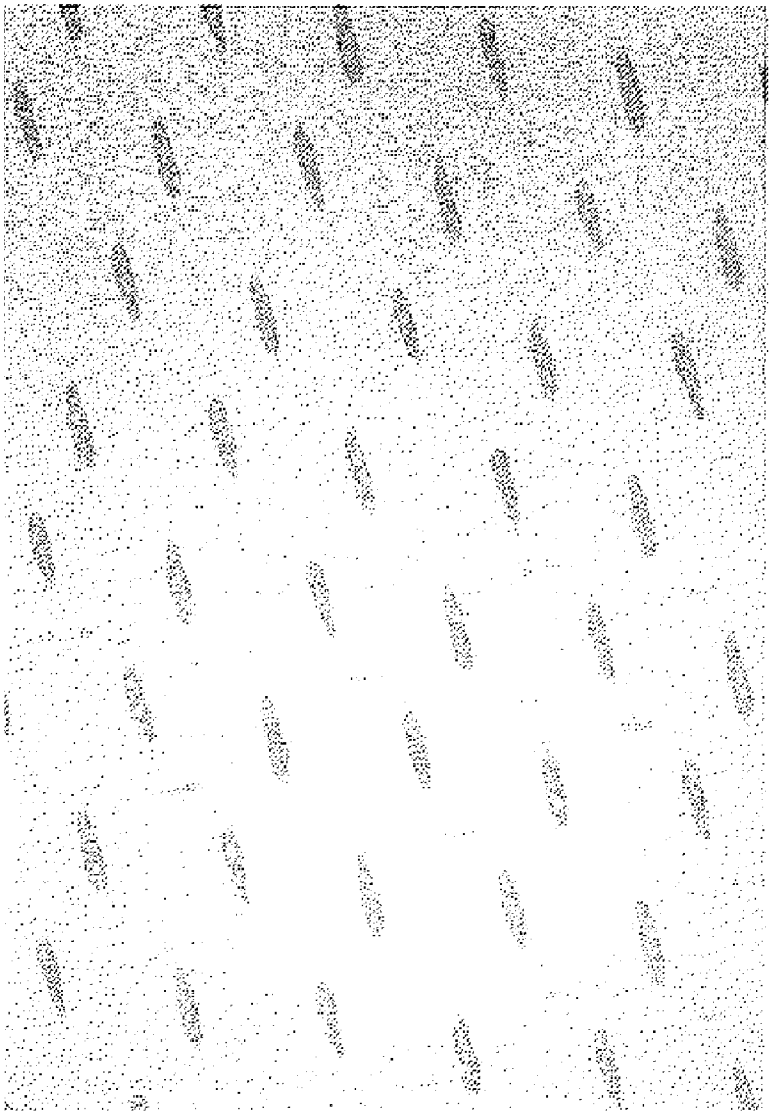
FIG. 30 is an impression made of the paper side of the woven fabric of FIGS. 1 and 25-29.

Views of the weave patterns are also shown in FIGS. 28 and 29 with FIG. 30 illustrating the possible impression view of the top of the structured fabric 28. FIG. 28 is a picture of the paper side weave and FIG. 29 is a picture of the opposite side of structured fabric 28. FIGS. 28 and 29 are substantially similar since the weave patterns are of a symmetrical nature. FIG. 30 shows an impression that illustrates the contact points of structured fabric 28. The weft yarns are prouder than the warp yarns, which can reflect the relative sizes of the weft and warp yarns, the shaping of the yarns or use factors such as tension on structured fabric 28 while in use.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pressing arrangement for use in a papermaking machine, comprising:

a permeable first fabric;

a permeable second fabric, a paper web being disposed between said first fabric and said second fabric;

a pressure producing element being in contact with said first fabric;

a support surface of a supporting structure being in contact with said second fabric;

a differential pressure arrangement providing a differential pressure between said first fabric and said support surface, said differential pressure acting on at least one of said first fabric, the paper web and said second fabric, the paper web being subjected to mechanical pressure and experiences a hydraulic pressure so as to cause water to be drained from the paper web, the pressing arrangement being arranged to allow air to flow in a direction through said first fabric, the paper web and said second fabric, said first fabric including:

a plurality of weft yarns;

a plurality of warp yarns; and a woven fabric resulting in said first fabric from a repeating pattern of said weft yarns and said warp yarns, each said weft yarn in said repeating pattern having a sequence of starting at a starting point then sequentially going over only three adjacent warp yarns, under only one warp yarn, over only one warp yarn, under only three warp yarns, over only one warp yarn, and under only one warp yarn, said sequence repeating.

2. The pressing arrangement of claim 1, wherein said first fabric is a Through-Air-Drying fabric.

3. The pressing arrangement of claim 1, wherein said first fabric has a three-dimensional structure.

4. The pressing arrangement of claim 1, wherein said second fabric includes at least one of a felt and a batt layer.

5. The pressing arrangement of claim 1, wherein said plurality of weft yarns include a first weft yarn and a second weft yarn being adjacent to said first weft yarn, said starting point of said second weft yarn being offset an odd number of warp yarns from said starting point of said first weft yarn.

6. The pressing arrangement of claim 5, wherein said plurality of weft yarns further includes a third weft yarn adjacent to said second weft yarn, said starting point of said third weft yarn being offset an even number of warp yarns from said starting point of said first weft yarn.

7. The pressing arrangement of claim 6, wherein said plurality of weft yarns further includes a fourth weft yarn, a fifth weft yarn, a sixth weft yarn, a seventh weft yarn, an eighth weft yarn, a ninth weft yarn and a tenth weft yarn, each being adjacent to the numerical preceding and succeeding weft yarn, each odd weft yarn having said starting point offset by an even number of warp yarns from said first weft yarn.

8. The pressing arrangement of claim 7, wherein said starting point of said second weft yarn is offset by three warp yarns in a first direction from said starting point of said first weft yarn.

9. The pressing arrangement of claim 8, wherein said starting point of said tenth weft yarn is offset by three warp yarns in a second direction from said starting point of said first weft yarn, said second direction being opposite of said first direction.

10. The pressing arrangement of claim 9, wherein said staring points of said weft yarns are offset from said starting point of said first weft yarn in said first direction as follows:

| | Offset |
|---|---|
| said first weft yarn | 0 |
| said second weft yarn | 3 |
| said third weft yarn | 6 |
| said fourth weft yarn | 9 |
| said fifth weft yarn | 2 |
| said sixth weft yarn | 5 |
| said seventh weft yarn | 8 |
| said eighth weft yarn | 1 |
| said ninth weft yarn | 4 |
| said tenth weft yarn | 7. |

* * * * *